United States Patent [19]

Baudry et al.

[11] Patent Number: 4,743,796

[45] Date of Patent: May 10, 1988

[54] ELECTRON GUN FOR REDUCTION OF GLIMMER

[75] Inventors: Jacques Baudry, Ecully; Olivier Trinchero, Lyons; Gérard Proudhon, Venissieux, all of France

[73] Assignee: Videocolor, Montrouge, France

[21] Appl. No.: 860,233

[22] Filed: May 6, 1986

[30] Foreign Application Priority Data

Aug. 14, 1985 [FR] France ..... 85 12419

[51] Int. Cl.[4] ..... H01J 29/06; H01J 29/62

[52] U.S. Cl. ..... 313/414; 313/447; 313/449; 313/458

[58] Field of Search ..... 313/414, 449, 458, 409, 313/447

[56] References Cited

U.S. PATENT DOCUMENTS 3,374,379 3/1968 Maruyama et al. ..... 313/85
3,852,608 12/1974 Johanns et al. ..... 313/449
4,620,134 10/1986 Peels et al. ..... 313/414 X

FOREIGN PATENT DOCUMENTS 81736 5/1985 Japan ..... 313/414

OTHER PUBLICATIONS

Patents Abstracts of Japan, vol. 8, No. 8(E-221)[1445], 13 Jan. 1984 & JP-A-58 175 244 and JP-A-58 175 245 (Mitsubishi Denki K.K.).

*Primary Examiner*—David K. Moore
*Assistant Examiner*—K. Wieder
*Attorney, Agent, or Firm*—Oblon, Fisher, Spivak, McClelland & Maier

[57] ABSTRACT

Electron gun for cathode ray tube, the electrostatic lenses of which comprise an electrode that remains at a high voltage after shut-down of the power supply of the tube, wherein in order to reduce the effect, apparent through an interference glimmer upon the screen on the K cathode of the high voltage remaining on the electrode after shutdown of the power supply, means for masking this voltage are provided that form part of an electron gun electrode of intermediary position between the first high voltage electrode and the cathode, and wherein preferably, the intermediary electrode has an elongated form according to the axis of the gun with two end walls, of which that turned towards the cathode has a greater thickness than the thickness of the opposite wall.

18 Claims, 2 Drawing Sheets

FIG_1
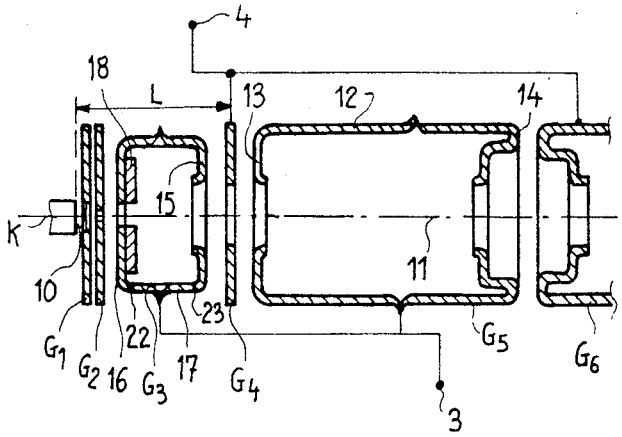
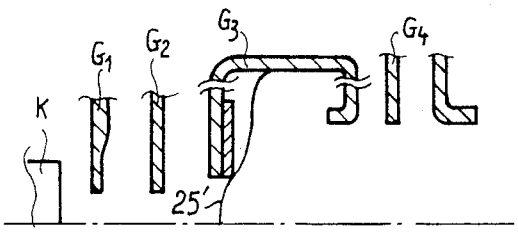
FIG_2-b
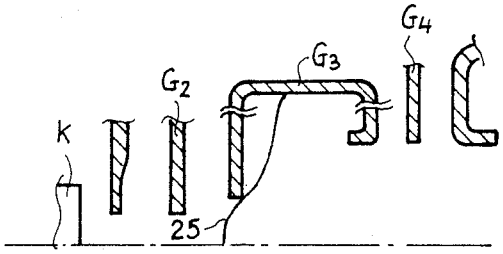
FIG_2-a
FIG_3
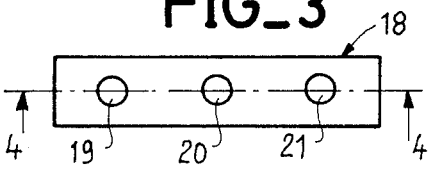
FIG_4
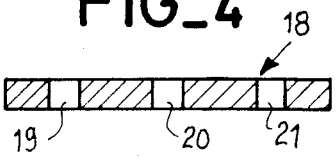
FIG_5
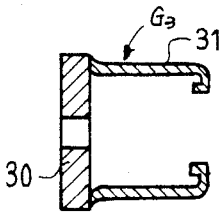
FIG_6
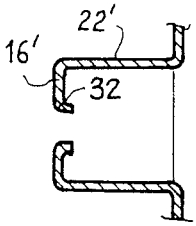

ELECTRON GUN FOR REDUCTION OF GLIMMER

BACKGROUND OF THE INVENTION

1. Field of the invention

The present invention concerns an electron gun for a cathode ray tube, especially for color television.

A cathode ray tube is constituted by a glass envelope under vacuum presenting at its rear portion a plate-screen the internal face of which is covered with cathodoluminescent material (called luminophorous material) emitting a visible light radiation when they are excited by an electron beam produced by one or several electron guns. For visualization in color the screen is generally formed of triple lines of luminophosphoruses, one line for each primary color, normally red, green and blue. In a color visualization tube of the shadow mask type, three electron guns are foreseen, each being intended to excite a particular color, the perforated mask disposed before the screen allowing the electron beam foreseen for one color only excites the light-emitting or luminophor particles of that color.

An electron gun is formed, on the one hand, of a cathode having a surface emitting electrons when it is heated by a filament and, on the other hand, of electrodes or grids generally designated $G_1$, $G_2$, $G_3$, etc, the index representing the position with respect to the cathode, this index increasing with the distance away from the cathode of which the first two $G_1$ and $G_2$ performing a prefocalization of the electron beam and the following $G_3$, $G_4$, etc. form electrostatic lenses for focussing and concentrating the electron beam. The modulation of the electron beam as a function of the intensity of the point or dot to be projected onto the screen is obtained through the modulation of the voltage of the cathode or by the modulation of the voltage of the first grid $G_1$ (Wehnelt).

The electrodes of the electrostatic grids are normally brought to very high voltages, most frequently of about several kilovolts. The invention concerns more particularly a tube, at least one grid of which of the electrostatic lenses is, during normal working, brought to a very high voltage, of about 25 kilovolts, for example, and which retains a voltage of the same value over a long period of time after the shut-down of the supply of this tube. This voltage does not disappear immediately for the following reason: the glass envelope has an internal conductive coating to which is connected the said grid as well as an external conductive coating brought to a voltage of the mass; the glass envelope thus constitutes, with its coatings, a large-capacity condensor that retains its load over a long period even after it has been disconnected from its power supply; due to this fact, the internal coating and the electrode to which it is connected maintain the high voltage.

It has been noted that the high voltage maintained on the grid could provoke - when the distance separating this grid from the cathode is relatively small - the projection of electrons on the center of the screen, being apparent by one or several visible luminous patches whereas the temperature of the cathode remains high. Such a defect is sometimes called "the cathode glimmer".

In order to overcome this drawback, it has been proposed to dispose in the circuit outside the tube discharge diodes. But this solution remains costly.

SUMMARY OF THE INVENTION

The invention allows to suppress at low cost the cathode glimmer phenomenon appearing upon shut-down of the power supply to the tube.

It is characterized in that, in order to remove the cathode further away from the effect of the high voltage remaining on a grid after the shut-down of the power supply to the tube, masking means are disposed between this grid and the cathode. In one embodiment, these masking means form part of an intermediary grid which, after shut-down, is brought to the voltage of the mass. Preferably, this intermediary grid, which has an elongated shape with transversal end walls, is such that the end wall the closest to the cathode is thicker than the opposite wall; in a variant, the aperture of this end wall the closest to the cathode, presents an edge or flange, advantageously turned over towards the inside of this elongated grid.

In another embodiment, the intermediary grid which has an elongated form with transversal end walls is such that the furthest end wall has an aperture the diameter of which is substantially smaller than that of the aperture of the grid remaining at high voltage. It has been observed that good results are obtained when the ratio between these diameters is smaller than 0.92.

BRIEF DESCRIPTION OF THE DRAWINGS

Other features, objects and advantages of the present invention will become apparent from reading the following description of preferred embodiments, given by way of non-limitative illustration with reference to the appended drawings in which:

FIG. 1 is a schematic diagram in cross-section of an electron gun for a color television tube, with three beams in line comprising the improvement of the invention;

FIGS. 2*a* and 2*b* are still more schematic drawings of electron guns of the same type as those of FIG. 1, on the one hand without, and on the other hand with, the improvement of the invention and showing the effect of this improvement;

FIG. 3 shows a piece of the gun represented in FIG. 1:

FIG. 4 is a cross-section according to line 4—4 of FIG. 3;

FIG. 5 represents a grid of the gun represented in FIG. 1 for a variant;

FIG. 6 represents a part of a grid of an electron gun shown in FIG. 1 for another variant.

DESCRIPTION OF THE PREFERRED EMBODIMENTS

Figure 7:
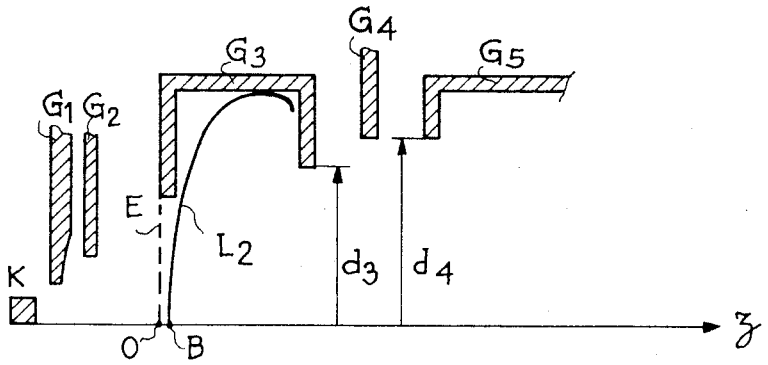
FIG. 7 is a view similar to that of FIG. 2*b* but for a variant.

The example that will now be described with respect to the figures concerns an electron gun for a color television tube of the mask type, the three beams produced by the gun (triple) being called "in line", i.e. coplanar.

Such an electron gun comprises, on the one hand, three K cathodes, each presenting an emitting surface 10 perpendicular to the axis 11 of the tube and heated by a filament (not represented) and, on the other hand, an assembly of electrodes $G_1$, $G_2$, $G_3$, $G_4$, $G_5$ and $G_6$, the first two of which $G_1$ and $G_2$, perform the prefocussing and the following electrodes $G_3$ to $G_6$ constitute electrostatic lenses for focussing and concentrating the electron beams.

A K cathode is disposed according to the axis 11 of the tube, whereas the axes of the two others are parallel to the axis 11, in the same plane, and in positions symmetrical with respect to this axis 11.

The electrodes $G_1$, $G_2$ and $G_4$ have a general planar form, each comprising three circular apertures centered upon the axis of the corresponding cathode in order to allow to pass the electron beam issuing from this cathode whereas the elongated electrodes, substantially in the form of cylinders or parallelipipeds $G_3$, $G_5$ and $G_6$ present end walls each of which also comprises three circular apertures centered upon the axis of the corresponding cathode. FIG. 1, being a crosssection according to the axis of the tube, only shows the central cathode and the corresponding apertures of the electrodes.

The electrodes or grids $G_3$ and $G_5$ are connected to a terminal 3 receiving a voltage of a mean value of about 8 kilovolt, whereas the electrodes or grids $G_4$ and $G_6$ are connected to a terminal 4 connected to high-value voltage source of about 25 kilovolt. In a manner known per se, the assembly formed by the electrodes or the grids $G_3$, $G_4$ and $G_5$ constitutes an electrostatic lens of the unipotential type, called a Heinzel lens, whereas the electrodes or grids $G_5$ and $G_6$ constitute an electrostatic lens called a bipotential lens.

Each of these electrodes is metallic and is produced from a leaf of a constant thickness. Therefore, the elongated part 12 of the electrode $G_5$ has the same thickness as the end walls 13 and 14. In the example, in order to facilitate manufacture of the electron gun, the apertures of the electrode $G_4$ and of the end walls of the electrodes $G_5$ and $G_6$, as well as the apertures of the end wall 15 of the grid $G_3$ that is the furthest removed from the K cathode all have the same diameter. On the contrary, the aperture of the grids $G_1$ and $G_2$ as well as the apertures of the wall 16 of the grid $G_3$ which is turned towards the K cathode, have smaller diameters.

The grid $G_3$, like the grid $G_5$, has a generally cylindrical and parallelipipedic form with the same thickness as the cylindrical wall 17 and end walls 15 and 16. But upon wall 16, of the same thickness as wall 15, is welded, according to an embodiment of the invention, a plate or insert 18 (FIGS. 3 and 4) with apertures 19, 20 and 21 corresponding to the apertures of the wall 16, i.e. having the same diameter and the same relative disposition. The plate 18 is welded against the internal face of wall 16, for example, by four welding spots in the vicinity of its corners.

This welding is carried out prior to mounting the electrodes, i.e. before the two cups 22 and 23 constituting the two parts of the electrode $G_3$ have been associated to each other.

In the example, the assembly constituted by the walls 16 and 18 presents a thickness which is about three times greater than the thickness of the wall 15. In other words, the insert 18 has a thickness that is approximately twice that of the walls of the original grid $G_3$.

As explained herein-above, upon the shut-down of the power to the tube terminal 4 retains a voltage of about 25 Kilovolts, whereas the voltages of the other electrodes reach almost immediately a zero value (potential of the mass).

The distance L separating the K cathode from the electrode $G_4$ being relatively small, of about 1 cm in the example, the influence of the voltage of this electrode $G_4$ can thus become effective in the vicinity of the K cathode and provoke the undesired formation of an electron beam according to the axis of the gun, thereby provoking an interference glimmer upon the center of the screen. This is the reason why, without the improvement to the invention, as shown in FIG. 2*a*, the equipotential surface 25 (from 3.5 to 5 volts) constituting the limit of the influence zone of the voltage induced by the electrode $G_4$ is present in the vicinity of the grid $G_2$; a significant proportion of electrons thus reach the central zone of the screen. On the contrary, with the improvement according to the invention, as shown in FIG. 2*b*, the influence limit 25' of the voltage induced by the grid $G_4$ is distinctly more remote from the K cathode, thereby considerably decreasing the proportion of electrons that reach the central part of the screen and therefore there will be practically no interference glimmer visible on the centre of the screen.

Experiments have shown that, without the improvement according to the invention, with a wall 16 having a thickness of 0.25 mm, and a nominal supply voltage of the filament of the K cathode of 6.3 volts the interference glimmer is visible when the voltage on the grid $G_4$ reaches 12 Kilovolts. On the contrary, with the improvement of the invention, the thickness of the grid $G_3$ anterior wall turned towards the cathode, being of 0.75 mm, the glimmer interference only appears if the supply voltage of the filament of the cathode is 9 volts and if the electrode $G_4$ is brought to a voltage of at least 32 Kilovolts.

In this example, the thickness of the anterior wall of the grid $G_3$ is about three times the thickness of its rear wall 15. A sufficient result which achieves elimination of the cathode glimmers is further obtained when this thickness of the anterior wall is equal to about twice the thickness of the rear wall.

In the variant represented in FIG. 5, the electrode $G_3$ is formed of two parts, the first part comprising only the anterior wall 30 having a greater thickness that the remainder 31, of electrode $G_3$. This second part 31 comprises the elongated portion and the other end wall. The parts 30 and 31 are joined together, for example, by welding.

FIG. 6 represents a further embodiment in which the anterior wall 16' of the electrode $G_3$ has the same thickness as the other parts of this electrode but where the apertures of this wall 16' are all surrounded by a flange or edge 32. The advantage of this embodiment is that it only implies a slight modification of the known electron gun.

In one variant of the embodiment represented in FIG. 1, the holes or bores 19, 20 and 21 of the insert 18 have a diameter greater than the diameter of the corresponding holes of the wall 16. But in this case, it is preferable that the thickness of the insert be greater than that which it presents when the diameters are equal. In other words, it is preferable that the thickness of the insert increases with the diameter of its aperture.

In the embodiment represented in FIG. 7, the aperture of the wall 13 of the grid $G_3$ presents a diameter $d_3$ smaller than the diameter $d_4$ common to the aperture of the grid and to the front or anterior aperture, turned towards the cathode, of the grid $G_5$. In other words, the $d_3/d_4$ ratio is smaller than 1.

The equipotential line $L_2$, corresponding to the line 25 of FIG. 2*A* (or 25' of FIG. 2*b*) intersects the axis z at a point B practically inside the grid $G_3$. It will be noted there also that the influence of the high voltage of the grid $G_4$ is thus decreased through reducing the diameter $d_3$ (if it is compared to FIG. 2*a*). It has been observed that a $d_3/d_4$ ratio of 0.6875 would allow to obtain a good compromise between the quality of the cathode image in image formation and the reduction of the interference glimmer of the cathode upon shut-down of the power supplies.

However, the hole of the wall $15_1$ of the grid $G_3$ presents, as shown in FIG. 1, a cylindrical flange that advances within the cylinder $G_3$. This flange can be obtained through manufacture of grid $G_3$ by extrusion. Its effect allows to reduce the decrease of the $d_3/d_4$ ratio necessary for the invention. In one embodiment, for a compromise comparable to that previously obtained a $d_3/d_4$ ratio of 0.844 is obtained.

The present invention produces the result required by limiting the influence of the high-level equipotential lines in the beam formation zone. In technological processes other than that described herein-above, a similar effect can be produced, especially through an increase of the dimensions of the grid holes or bores following the very high voltage grid.

The invention also applies to the case where the grid $G_4$ is thick, for example being produced in the form of a cylinder. Its vicinity to the filament remaining unchanged, the problem and the solution of the invention remain the same.

What is claimed is:

1. Electron gun for a cathode ray tube, especially for color television, the electrostatic lenses of which comprise an electrode $G_4$ that remains at a high voltage after the shut-down of the tube power supply, wherein, in order to reduce the effect upon a K cathode of the high voltage remaining on the said electrode $G_4$ after shut-down of the power supply, the gun comprises means for imparting to the distance between the cathode and a equipotential surface constituting the limit of the influence zone of the voltage induced by the first high voltage electrode ($G_4$) a value such that the high voltage remaining on said electrode ($G_4$) after shut-down of the power supply has a small effect upon the cathode, said means including masking means that form a part of an electrode of the electron gun of intermediary position between the high voltage electrode and the cathode.

2. Electron gun according to claim 1, wherein the intermediary electrode has an elongated form according to the axis of the gun with two end walls, the end wall turned towards the cathode having a greater thickness than the opposite wall.

3. Electron gun according to claim 2, wherein the ratio between the thickness of the end walls of the intermediary electrode $G_3$ is at least about 2.

4. Electron gun according to claim 2, wherein the intermediary electrode comprises a main portion with end walls of equal thicknesses and a corresponding insert on the end wall facing the cathode.

5. Electron gun according to claim 4, wherein the insert is welded upon the end wall.

6. Electron gun according to claim 4, wherein the insert is laid upon the face of the end wall of the intermediary electrode is within this electrode.

7. Electron gun according to claim 2, wherein the intermediary electrode comprises two portions, one of which is constituted by the thickest end wall and the other of which is constituted by the longitudinal portion and the other end wall.

8. Electron gun according to claim 1, wherein the intermediary electrode presents an elongated shape with two end walls, the aperture of an end wall of the intermediate electrode turned towards the cathode presenting an edge.

9. Electron gun according to claim 8, wherein the edge is turned towards the inside of the intermediary electrode.

10. Electron gun according to claim 2, wherein the diameter of the circular aperture of the electrode, brought to a high voltage, is equal to the diameter of the corresponding aperture of the rear end wall, opposite the cathode, of the intermediary electrode.

11. Electron gun according to claim 1, wherein the intermediary electrode has an elongated shape according to the axis of the gun with two end walls, the wall turned towards the high voltage electrode having a hole of diameter ($d_3$) such that the ratio of this diameter ($d_3$) to that ($d_4$) of the hole of the high voltage electrode is substantially lower than 1.

12. Electron gun according to claim 11, wherein the ratio of the diameter ($d_3$) of the hole of the intermediary electrode to that ($d_4$) of the hole of the high voltage grid is smaller than 0.92.

13. Electron gun according to claim 12, wherein the said ratio is 0.69.

14. Electron gun according to claim 12, wherein the said ratio is about 0.85.

15. Electron gun according to claim 11, wherein the hole of the wall of the intermediary electrode that is turned towards the high voltage electrode is surrounded by a flange towards the inside of the intermediary grid ($G_3$).

16. Electron gun according to claim 1, further comprising comprises a bipotential lens and a unipotential lens, the high voltage electrode and the intermediary electrode both forming part of the unipotential lens.

17. Cathode ray tube, wherein it comprises an electron gun according to claim 1.

18. Color television receiver, wherein it comprises a tube according to claim 17.

* * * * *